United States Patent [19]

Langenohl

[11] 4,042,184

[45] Aug. 16, 1977

[54] PUMP HOSE RETRIEVER

[76] Inventor: Willard J. Langenohl, 11142 W. Bradley Road, Milwaukee, Wis. 53224

[21] Appl. No.: 719,724

[22] Filed: Sept. 2, 1976

[51] Int. Cl.[2] ..... B65H 75/36

[52] U.S. Cl. ..... 242/47.5

[58] Field of Search ..... 242/47.5, 55.01; 222/529, 530; 137/355.16, 355.2, 355.23

[56] References Cited

U.S. PATENT DOCUMENTS

| | | | |
|---|---|---|---|
| 2,214,759 | 9/1940 | Bosch, Jr. | 242/47.5 |
| 2,466,996 | 4/1949 | Monnot | 242/47.5 |
| 2,504,269 | 4/1950 | Logan | 222/530 X |
| 2,545,063 | 3/1951 | Wolfe | 242/47.5 X |
| 2,944,748 | 7/1960 | Carnagua et al. | 242/47.5 |

*Primary Examiner*—Stanley N. Gilreath

*Attorney, Agent, or Firm*—Andrus, Sceales, Starke & Sawall

[57] ABSTRACT

A pump hose retriever which has a cable extending from a column and adapted to be attached to a fuel discharge hose. A tension weight inside the column is connected to the cable to always hold the cable taut and when the cable is pulled out of the column, forces a counterweight upwardly in the column which carries a pawl lodging in apertures in the column housing upon a slight release of the cable by the operator. Abutments at the upper and lower end of the housing are employed to alternately release the pawl and place it again in operating position. The counterweight, upon release of the pawl, is free to move downwardly in the column and with the tension weight readily retracts the cable for storing in the column.

7 Claims, 7 Drawing Figures

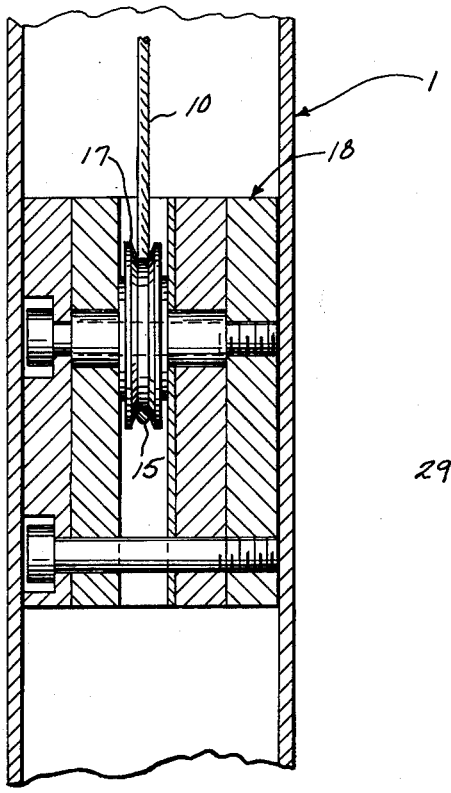
Fig. 3
Fig. 7
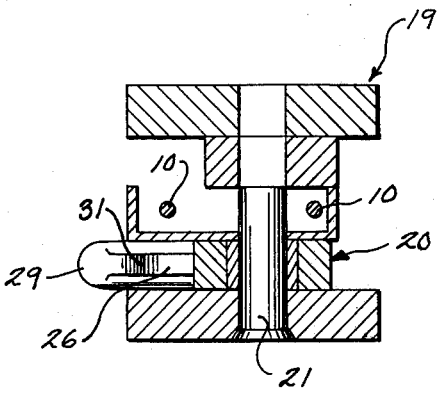
Fig. 4
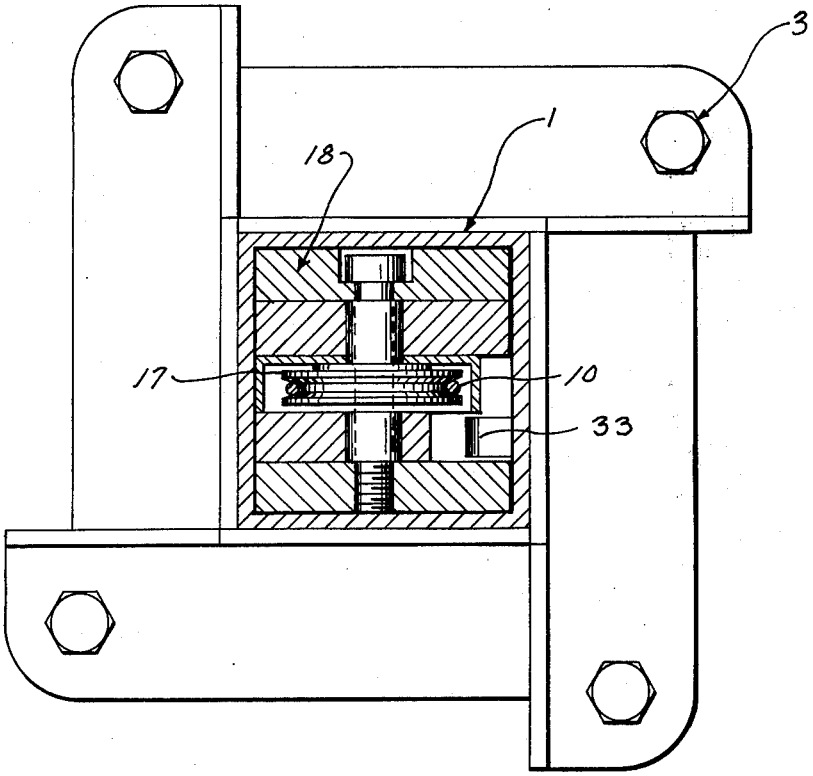

PUMP HOSE RETRIEVER

BACKGROUND OF THE INVENTION

The pump hose retriever of the invention finds particular use by an operator in fueling large tractors and trucks with a minimum effort in the handling of a long, bulky hose. The fuel tanks on these large vehicles are located on all sides, requiring the use of a lengthy hose. During the refueling process, the nozzle may inadvertently leave the operator's hands and the cable attached to the hose will be retracted. The present invention overcomes this problem by reducing the pull back on the cable to a minimum by employing a tension weight until the operator is ready to replace it in storage position. The invention then provides for ready release of a counterweight by the operator so that the hose may be easily replaced in storage position by the counterweight engaging the tension weight.

SUMMARY OF THE INVENTION

In general, the invention is directed to a cable which is stored in a stand or column in a looped extent. This, for example, permits ample space in a six foot column to store up to 20 foot by 1 inch pump hose at the proper height for a fueling island. One end of the cable is secured to the fuel discharge hose and the cable is then looped inside the column and secured at the other end to the upper end of the column.

One of the most common problems found in present retrievers is cable twisting and fouling. The column of the present invention is preferably square in shape and the weights which travel in the column are preferably square in shape. The pulley swivel can turn no further than approximately 178 degrees and twisting, therefore, is almost an impossibility.

The cable within the column extends through a counterweight and then downwardly and is looped around a pulley on a tension weight. The counterweight is considerably greater in weight than the tension weight.

The counterweight carries a pawl which is tensioned to operative and inoperative positions by a coil spring and actuated to over center positions by cams or abutments located at the upper end and lower end of the column.

In initial position the pawl rides over apertures in the column wall as it is pulled upwardly by engagement of the tension weight with the counterweight when the cable is pulled by an operator. The pawl is lodged in an aperture when the operator permits slight retraction of the cable to thereby prevent retraction of the counterweight.

To unlatch the pawl, the operator pulls on the cable to engage the upper cam so that the weights are then free to move downwardly in the column and the cable is retracted by the counterweight to storage position. The cam at the lower end of the column engages the pawl to reset it so that it may again be anchored when pulled upwardly by engagement of the weights when the operator pulls on the cable.

In single pulley counterweight retrievers, the speed of the weight travel in the column is exactly the speed the hose is permitted to pull back into a storage position. The weight finally has to come to a stop by either striking the bottom of the column or the end of the cable hits the pulley. Either of which may have damaging consequences. In the compound pulley retriever of the present invention, the weight speed is only half of that of the hose. This reduces the impact of the weight which is easily absorbed by a rubber pad at the bottom of the column.

BRIEF DESCRIPTION OF THE DRAWINGS

FIG. 3 is a section taken on line 3—3 of FIG. 1 and illustrating the cable looped around the lower pulley which is secured to the lower weight;

FIG. 4 is a section taken on line 4—4 of FIG. 1 and illustrates the square construction of the column;

FIG. 7 is a section taken on line 7—7 of FIG. 5.

DETAILED DESCRIPTION OF THE DRAWINGS

Figure 1:
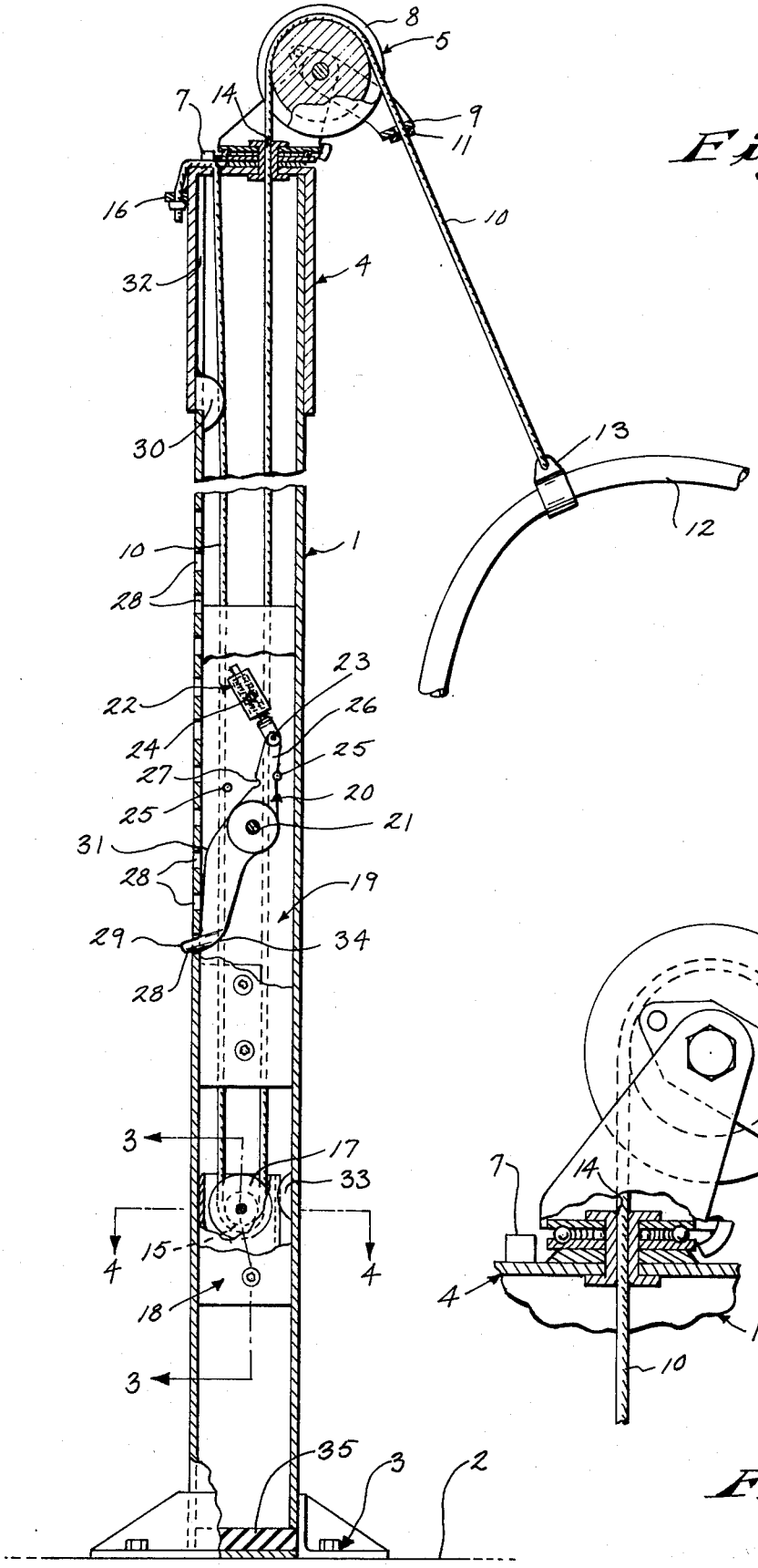
FIG. 1 is a cross-sectional view of the pump hose retriever with parts in elevation and with the pawl in locked position.
Figure 2:
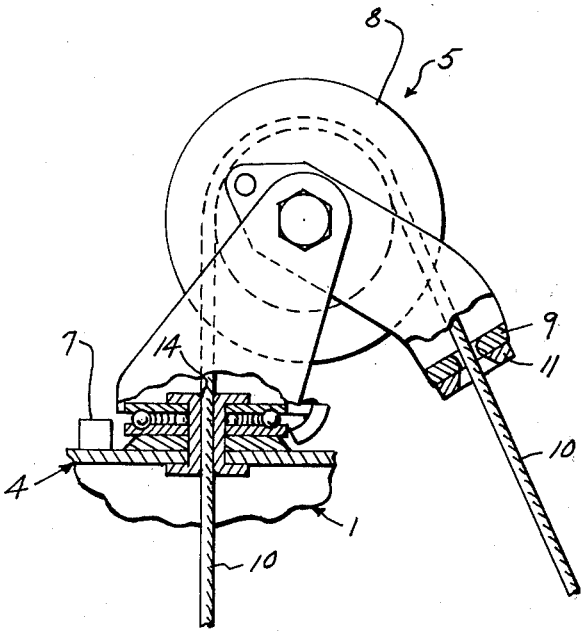
FIG. 2 is a detailed view of the caster at the upper end of the column with parts in section.

Referring to the drawings, there is shown a free standing hollow column or stand 1 which is mounted to the concrete island 2 by the angle iron and anchor bolts 3. Column 1 preferably has a square shape.

The upper end of column 1 is closed by the cap 4 and a caster 5 having a pair of arms and ball bearings 6 on the bottom is pivoted to the top of cap 4 and rotates on cap 4 by means of ball bearings 6. The rotation of caster 5 is limited by the stop 7. Caster 5 supports a freely rotatable pulley 8 and arm or cable guide 9 is secured thereto and the cable 10 extends over pulley 8, and within guide 9 and outwardly therefrom through bushing 11. The bushing 11 is disposed at the outer end of guide 9 to provide a confined support for cable 10.

The outer end of cable 10 is secured to the fuel discharge hose 12 as at 13. Cable 10 in turn extends rearwardly over pulley 8 and thence into the column 1 through aligned opening 14 in caster 5 and the cap 4.

Cable 10 then extends downwardly in column 1 to substantially the lower end of the column, as shown in FIG. 1, for purposes of illustration, and is looped as at 15 to pass upwardly within column 1 and through cap 4 and is secured to the peg 16 on the upper end portion of column 1.

In its extent within column 1, the loop 15 of cable 10 extends around the idler pulley 17 which is pivoted to the generally square weight 18 formed of several plates which are bolted together. Weight 18 is of the order of three to five pounds to offset the weight of the cable and hose and operates as a cable tension weight to take up slack in the cable and prevent twisting.

Figure 6:
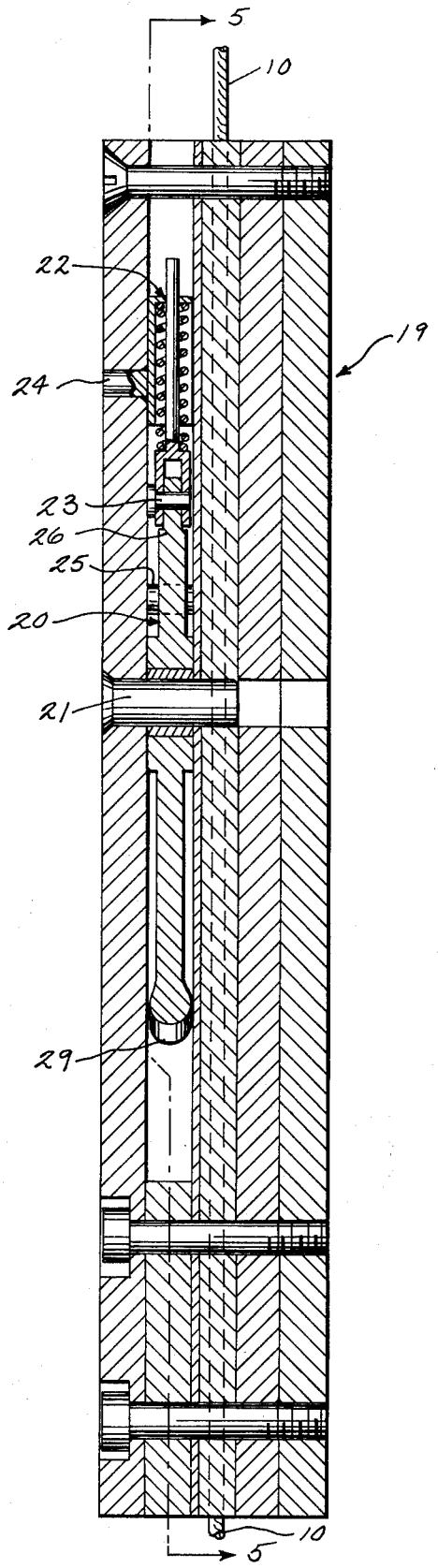
FIG. 6 is a section taken on line 6—6 of FIG. 5.

In its extent to and from weight 18, cable 10 extends through elongated openings in a second weight 19, as may be seenin FIG. 6, which is a counterweight of approximately twenty pounds or of considerably greater weight than tension weight 18.

Counterweight 19 is an elongated, generally square member and may be formed of several flat members bolted together and normally freely floats within column 1 unless latched into fixed position. The pawl 20 is centrally pivoted to the pin 21 which is secured to counterweight 19.

Pawl 20 is retained at the upper end by the coil spring 22 assembly which is secured at the lower end to pawl 20 as at 23 and at the upper end to a pin 24 on counterweight 19. In addition, the pin stops 25 are secured to counterweight 19 on either side of the arm 26 of pawl 20 to limit the pivotal movement of pawl 20. Arm 26 is provided with recesses 27 on opposite sides of the shape of pin stops 25 to receive the latter and govern the rotatable movement of pawl 20.

Column 1 is provided with a plurality of apertures 28 throughout a substantial extent of column 1, as seen in FIG. 1. The foot 29 of pawl 20 is formed generally round and of a size to readily drop into apertures 28 as pawl 20 is moved downwardly in column 1 after the cable 10 has been pulled outwardly to an operating position.

Figure 5:
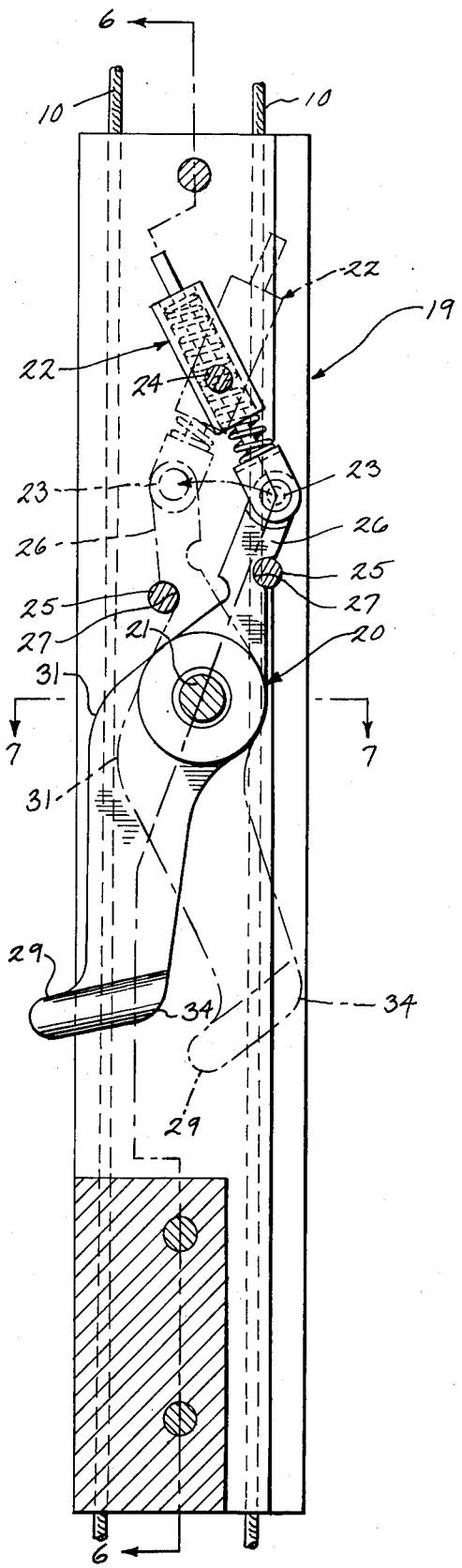
FIG. 5 is a section taken on line 5—5 of FIG. 6 illustrating the unlocked position of the pawl in phantom.

The pawl trip abutment or cam 30 is provided at one side of the upper end of column 1 at the lower end of cap 4 and engages the knee 31 of pawl 20 when the weight 19 is forced upwardly to trip pawl 20 to the non-actuated position shown in phantom in FIG. 5 of the drawings. Column 1 has a slot 32 so that cam 30 can be lowered in column 1 when cap 4 is placed over the top of the column and a portion of cam 30 is finally lodged inside column 1. At the lower end of column 1 and on the opposite side of column 1 from cam 30 is another cam 33 so that when counterweight 19 is in the lowered position, cam 33 will engage the heel 34 of pawl 20 and reset pawl 20 to a position to override the apertures when counterweight 19 is being pulled upwardly.

To absorb any possible impact of the weights when they reach the bottom of column 1, the rubber pad 35 may be employed.

The operation of the pump hose retriever of the invention is as follows.

When cable 10 is pulled outwardly by the service man pulling on cable 10 or hose 12, the tension weight 18 is pulled upwardly within column 1 and engages or is in engagement with counterweight 19 to which is pivoted pawl 20. Counterweight 19 is then pulled upwardly by cable 10 and tension weight 18 and the foot 29 of pawl 18 rides over apertures 28 in the wall of column 1.

When the service operator has extended cable 10 sufficiently to the position at which hose 12 will be in a position to discharge fuel from a pump, not shown, the operator releases hose 12 and cable 10 slightly so that the foot 29 of pawl 20 will lodge in an aperture 28. This prevents retraction of counterweight 19 as the operator discharges fuel from hose 12.

When the operator desires to retract cable 10, he pulls on cable 10 until knee 31 of pawl 20 engages upper cam 30 which kicks pawl 20 to the inactive position shown phantom in FIG. 5 of the drawings and the cable 10 is then retracted by counterweight 19 as the respective weights are lowered within column 1.

Pawl 20 is then reset when the cam 33 in the lower portion of column 1 engages heel 34 as counterweight 19 reaches the lower portion of column 1 to trip pawl 20 to the initial operative position shown in the drawings where foot 29 will pass over apertures 28 upon upward movement of counterweight 19.

Both of the weights when moving downwardly are free and suspended entirely by the cable looped around pulley 17 in tension weight 18 and are of ample weight to pick up the hose and return it to a position within the column where it is stored in a neat and orderly manner. Although the column is preferably square in shape, it, however, only requires a construction on the inside of the column to prevent the weights from rotating.

The components of the pump retriever consist of premanufactured items which can be readily purchased and require minimum modification to incorporate them into the final product. The column or stand employed is ordinarily of steel of stock size. The examples given of the tension and counterweight are not limiting and it is only required that the counterweight be of greater weight than the tension weight.

The compound pump hose retriever of the invention is of simple, rugged, trouble free and compact design. It takes very little room on an island. Mounted in place it can be readily taken for an island bumper post and is not an uncommon or unsightly object.

Various modes of carrying out the invention are contemplated as being within the scope of the following claims particularly pointing out and distinctly claiming the subject matter which is regarded as the invention.

I claim:

1. A pump hose retriever adapted to be connected to the discharge hose of a fuel pump, which comprises a hollow column disposed to be anchored in a fixed position, a pair of weights disposed inside the column with one being located above the other and the uppermost weight being of substantially greater weight than the lowermost weight and the lowermost weight being of a weight to keep the cable taut, means inside the column preventing rotation of the weights within the column, a cable secured to the upper portion of the column at one side thereof extending into the column and downwardly thereof when in nonservice position to substantially the bottom of the column and then reverse looped to extend upwardly and out the upper end of the column and disposed to be connected to the pump hose, meanssecured to the lower weight around which the cable is looped and the cable extending through elongated openings in the uppermost weight so that when the cable is pulled from the column the lower weight engages the uppermost weight and forces the latter upwardly in the column, spring loaded pawl means pivoted to the uppermost weight and the column having spaced apertures in the wall thereof over which the pawl means rides when moved upwardly with the uppermost weight within the column and in which the pawl means lodges upon a slight release of the cable by the operator, first cam means located inside the upper portion of the column, second cam means located inside the lower portion of the column in a position substantially opposite to the first cam means, and the first cam means engaging the pawl means to move it over center to a non-operative position so that the uppermost weight is free to move downwardly with the lowermost weight to retract the cable to a storage position inside the column, and the second cam means engaging the pawl means to move it over center to the initial position where it may again engage the apertures in the column and anchor the uppermost weight in a fixed position preventing retraction of the cable when the latter is in a service position.

2. The pump hose retriever of claim 1, and the means preventing rotation of the weights being a square construction of the inside of the column, and the weights also have a square configuration of a size for sliding movement within the column but prevented from rotation therein.

3. The pump hose retriever of claim 1, and a caster supported on ball bearings on the top of the column and secured thereto, a stop secured to the top of the column to limit the rotary movement of the caster, a pair of arms extending upwardly from the caster, a rotatable pulley supported by the arms and the cable extending over said pulley, and guide means having a bushing at the outer end through which the cable extends for attachment to the fuel hose.

4. The pump hose retriever of claim 1, in which the pawl means is a pawl of irregular construction having an upper arm, a coil spring secured to the upper end of the arm and pivoted to the uppermost weight, and the lower portion of the pawl having a foot of a construction to lodge in the apertures in the walls of the column to anchor the uppermost weight and the rear portion disposed to be engaged by the lowermost cam, and a knee portion which engages the upper cam to pivot the pawl to inoperative position so that the uppermost weight is free to be lowered within the column.

5. The pump hose retriever of claim 1, in which the lowermost weight is of weight to maintain tension on the cable when the cable is in service and the uppermost weight is a counterweight of substantially greater weight than the lowermost weight to readily retract the cable when it is to be located in a storage position.

6. The pump hose retriever of claim 1, and the upper portion of the column being formed of a removable cap which carries the upper cam at the lower end thereof, and a slot extending within the upper portion of the column to permit sliding of the upper cam within the slot and down to the inside of the column when the cap is placed over the upper end of the column.

7. The pump hose retriever of claim 1, and a rubber pad on the inside of the bottom of the column to absorb the impact of the weights when the weights are lowered to the bottom of the column.

* * * * *